US006630916B1

(12) United States Patent
Shinoda

(10) Patent No.: US 6,630,916 B1
(45) **Date of Patent: *Oct. 7, 2003**

(54) METHOD AND A CIRCUIT FOR GRADATIONALLY DRIVING A FLAT DISPLAY DEVICE

(75) Inventor: Tsutae Shinoda, Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/451,351

(22) Filed: Dec. 3, 1999

Related U.S. Application Data

(63) Continuation of application No. 08/888,442, filed on Jul. 3, 1997, now Pat. No. 6,097,357, which is a continuation-in-part of application No. 08/800,759, filed on Feb. 13, 1997, now Pat. No. 6,195,070, which is a continuation of application No. 08/469,815, filed on Jun. 6, 1995, now Pat. No. 5,661,500, and a continuation of application No. 08/458,288, filed on Jun. 2, 1995, now Pat. No. 5,674,553, said application No. 08/469,815, is a continuation of application No. 08/010,169, filed on Jan. 28, 1993, now abandoned, said application No. 08/458,288, is a division of application No. 08/010,169, application No. 09/451,351, which is a continuation-in-part of application No. 08/674,161, filed on Jul. 1, 1996, now Pat. No. 5,724,054, which is a division of application No. 08/405,920, filed on Mar. 16, 1995, now Pat. No. 5,541,618, which is a continuation of application No. 08/181,959, filed on Jan. 18, 1994, now abandoned, which is a continuation of application No. 07/799,255, filed on Nov. 27, 1991, now abandoned.

(30) Foreign Application Priority Data

| | | |
|---|---|---|
| Nov. 28, 1990 | (JP) | 2-331589 |
| Jan. 28, 1992 | (JP) | 4-012976 |
| Apr. 8, 1992 | (JP) | 4-106953 |
| Apr. 8, 1992 | (JP) | 4-106955 |
| Apr. 16, 1992 | (JP) | 4-96203 |
| Apr. 30, 1992 | (JP) | 4-110921 |

(51) Int. Cl.[7] ..... G09G 3/28

(52) U.S. Cl. ..... 345/60; 345/63; 345/68

(58) Field of Search ..... 345/60, 63, 68, 345/61, 66, 103; 313/584, 585, 586, 484, 485; 315/169.1, 169.5

(56) References Cited

U.S. PATENT DOCUMENTS

| | | | | |
|---|---|---|---|---|
| 3,886,403 A | | 5/1975 | Owaki et al. | 315/169 R |
| 3,906,290 A | | 9/1975 | Kurahashi et al. | 315/169 R |
| 3,972,040 A | | 7/1976 | Hilsum et al. | 340/324 M |
| 4,005,402 A | | 1/1977 | Amano | 340/324 M |
| 4,249,105 A | | 2/1981 | Kamegaya et al. | 313/484 |
| 4,368,465 A | | 1/1983 | Hirakawa et al. | 340/771 |
| 4,499,460 A | | 2/1985 | Pearson et al. | 340/771 |
| 4,516,053 A | | 5/1985 | Amano | 313/584 |
| 4,575,716 A | | 3/1986 | Holz et al. | 340/714 |
| 4,622,549 A | | 11/1986 | Criscimagna et al. | 340/805 |
| 4,638,218 A | | 1/1987 | Shinoda et al. | 315/169.4 |
| 4,716,341 A | | 12/1987 | Oida et al. | 315/169.4 |
| 4,737,687 A | | 4/1988 | Shinoda et al. | 315/169.4 |
| 4,814,758 A | | 3/1989 | Park | 340/771 |
| 4,833,463 A | | 5/1989 | Dick et al. | |
| 5,030,888 A | | 7/1991 | Salavin et al. | 315/169.4 |
| 5,086,297 A | | 2/1992 | Miyake et al. | 340/759 |
| 5,182,489 A | | 1/1993 | Sano | 313/485 |
| 5,541,618 A | * | 7/1996 | Shinoda | 345/60 |
| 5,661,500 A | | 8/1997 | Shinoda et al. | |
| 5,674,553 A | | 10/1997 | Shinoda et al. | |
| 5,724,054 A | | 3/1998 | Shinoda | |
| 5,828,356 A | | 10/1998 | Stoller | |
| 6,097,357 A | * | 8/2000 | Shinoda et al. | 345/63 |

FOREIGN PATENT DOCUMENTS

| | | |
|---|---|---|
| EP | 0 157 248 | 10/1985 |
| EP | 0 366 117 | 5/1990 |
| EP | 0 436 416 | 7/1991 |
| FR | 2 662 534 | 11/1991 |
| JP | 49-115242 | 11/1974 |
| JP | 50-135979 | 10/1975 |

| | | |
|---|---|---|
| JP | 51-032051 | 9/1976 |
| JP | 55-5663 | 2/1980 |
| JP | 56-094395 | 7/1981 |
| JP | 57-078751 | 5/1982 |
| JP | 61-039341 | 2/1986 |
| JP | 62-51133 | 3/1987 |
| JP | 62-180932 | 8/1987 |
| JP | 63-151997 | 6/1988 |
| JP | 63-060495 | 11/1988 |
| JP | 1-304638 | 12/1989 |
| JP | 1-311540 | 12/1989 |
| JP | 2-148645 | 6/1990 |
| JP | 02-219092 | 8/1990 |
| JP | 2-226699 | 9/1990 |
| JP | 02-291597 | 12/1990 |
| JP | 3-77238 | 4/1991 |
| JP | 03-078937 | 4/1991 |
| JP | 3-101031 | 4/1991 |
| JP | 3-269933 | 12/1991 |

OTHER PUBLICATIONS

Kubo, Akira et al., "Full Color Surface–Discharge ac Plasma Display Panels", ITEJ. Technical Report vol. 12, No. 49, pp. 49–54, EP '88–57.10 '88–93 (Nov. 1988).

Shinoda et al., "Low–Voltage Operated AC Plasma–Display Panels," *IEEE Transactions On Electron Devices*, vol. ED–26, No. 8, Aug. 1979, pp. 1163–1167.

Gay et al., "Color Plasma Display Panels with Simplified Structure and Drive," *SID 88 Digest*, SID International Symposium—Digest of Technical Papers, May 24–26, 1988, Anaheim, CA, pp. 157–159.

Ruckmongathan, T.N., "A Generalized Addressing Technique for RMS Responding Matrix LCDS," *1988 International Display Research Conference*, pp. 80–85.

Uchiike et al., "An 86–Ipi High–Resolution Full–Color Surface–Discharge ac Plasma Display Panels," *Proceedings of the SID*, vol. 31, No. 4, 1990, New York, NY, pp. 361–365.

Yoshikawa et al., "A Full Color AC Plasma Display with 256 Gray Scale," *Japan Display '92*, Article S16–2, pp. 605–608.

Holz, G.E., "Pulsed Gas Discharged Display with Memory," Burroughs Corporation, ECD, Plainfield, N.J. (2 pages).

Makino et al., "Improvement of Video Image Quality in AC–Plasma Display Panels by Suppressing the Unfavorable Coloration Effect with Sufficient Gray Shades Capability," *ASIA Display '95*, Proceedings of the Fifteenth International Display Research Conference, Oct. 16–18, 1995, Hamamatsu, Japan, Article S19–3, pp. 381–384.

Osamu, T., "Innovation and Commercial Viability of Large Area Plasma Display through Fujitsu's Continued R&D Activities," *IDW '96*, Proceedings of the Third International Display Workshops, vol. 2, Nov. 27–29, 1996, Kobe, Japan, pp. 7–10.

* cited by examiner

*Primary Examiner*—Dennis-Doon Chow
(74) *Attorney, Agent, or Firm*—Staas & Halsey LLP

(57) ABSTRACT

A method and circuit of driving a flat display panel formed of a plurality of cells each having a memory function, wherein the cells are formed at cross points of a plurality of X-electrodes and a plurality of Y-electrodes orthogonal to the X-electrodes and a period of a frame for displaying a single picture is divided into a plurality of sequential subframes. Each of the subframes comprises an addressing period, during which cells to be lit later in a display period are selected from all the cells by being written so as to have a wall charge therein, and a display period, subsequent to the address period, for lighting the selected cells by applying sustain pulses to all the cells. A number of sustain pulses included in each display period is predetermined differently for each subframe, according to a weight given to each subframe. Gradation of visual brightness of each cell is determined by the accumulated number of the sustain pulses included in the subframes that are selectively operated during a single frame according to a required brightness level for each cell. An adequate time accumulation is thereby allocated to a required number of subframes to achieve a quality brightness-gradation for each cell.

12 Claims, 8 Drawing Sheets

Fig.1
PRIOR ART
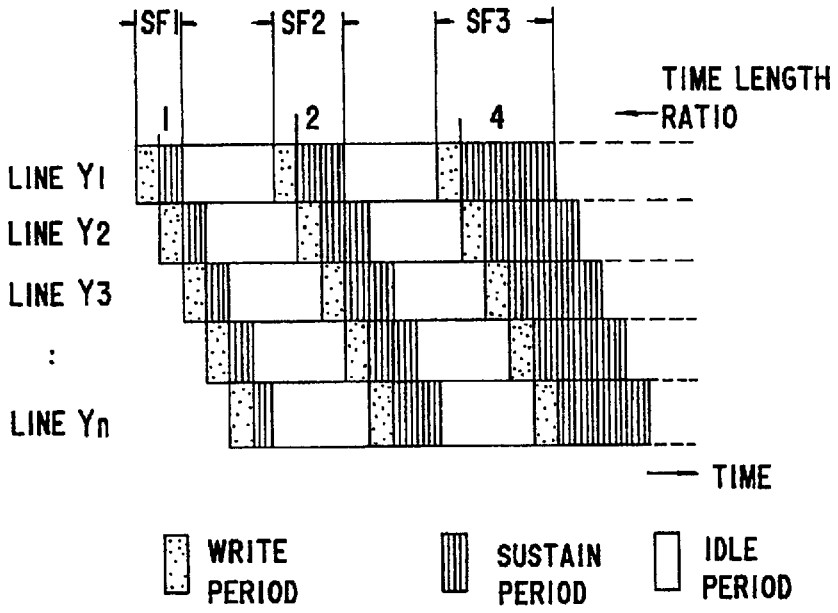
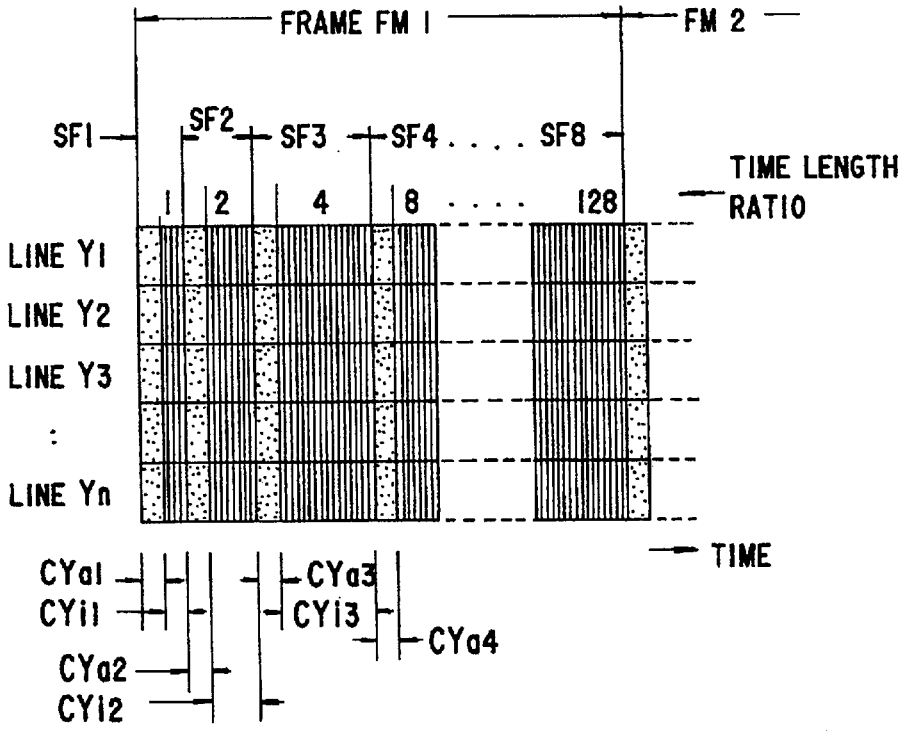
Fig.3

METHOD AND A CIRCUIT FOR GRADATIONALLY DRIVING A FLAT DISPLAY DEVICE

CROSS REFERENCE TO RELATED APPLICATIONS

This application is a continuation of application Ser. No. 08/888,442, filed Jul. 3, 1997, now U.S. Pat. No. 6,097,357 in turn a continuation-in-part of, and incorporates by reference herein each of:

(1) immediate (first) parent application Ser. No. 08/800,759, filed Feb. 13, 1997, now U.S. Pat. No. 6,195,070 in turn a continuation of Ser. No. 08/469,815, filed Jun. 6, 1995, now allowed as U.S. Pat. No. 5,661,500, and Ser. No. 08/458,288 filed Jun. 2, 1995, now allowed as U.S. Pat. No. 5,674,553, both, in turn a continuation and a divisional, respectively, of application Ser. No. 08/010,169, filed Jan. 28, 1993, now abandoned, and claims priority benefit under 35 USC §119 to Japanese Patent Application Nos. 4-012976, filed Jan. 28, 1992, 4-096203 filed Apr. 16, 1992, 4-106953 filed Apr. 8, 1992, 4-106955 filed Apr. 8, 1992, and 4-110921 filed Apr. 30, 1992; and (2) immediate (second) parent application Ser. No. 08/674,161, filed Jul. 1, 1996, now allowed as Ser. No. 5,724,054, in turn a division of Ser. No. 08/405,920, filed Mar. 16, 1995 and issued as U.S. Pat. No. 5,541,618 on Jul. 30, 1996, in turn a continuation of Ser. No. 08/181,959, filed Jan. 18, 1994, now abandoned, in turn a continuation of Ser. No. 07/799,255, filed Nov. 27, 1991, now abandoned, and claims priority benefit under 35 USC §119 to Japanese Patent Application No. 2-331589, filed Nov. 28, 1990.

BACKGROUND OF THE INVENTION

1. Field of the Invention

This invention relates to a method and apparatus for driving a flat display panel having a memory function, such as an AC-type PDP (plasma display panel), etc., to allow gradation, i.e. a gray scale, of its visual brightness for each cell.

2. Description of the Related Arts

Flat display apparatus, allowing a thin depth as well as a large picture display size, have been popularly employed, resulting in a rapid increase in its application area;. Accordingly, there has been required further improvements of the picture quality, such as a gradation as high as 256 grades so as to achieve the high-definition television, etc.;

There have been proposed some methods for providing a gradation of the display brightness, such as Japanese Patent Publication 51-32051 or Hei2-291597, where a single frame period of a picture to be displayed is divided with time into plural subframe's (SF1, SF2, SF3, etc.,) each of which has a specific time length for lighting a cell so that the visual brightness of the cell is weighted. A typical prior art method to provide the gradation of visual brightness is schematically illustrated in FIG. 1, where after cells on a single horizontal line (simply referred to hereinafter as a line) $Y_1$ are selectively written, i.e. addressed, cells on the next line $Y_2$ are then written. Structure of each subframe SFn on each scanned line, employed in an opposed-discharge type PDP panel, is shown in FIG. 2, where are drawn voltage waveforms applied across the cells on horizontal lines $Y_1$, $Y_2 \ldots Y_n$, respectively. Each subframe is provided with a write period CYw (or address period) during which a write pulse Pw, an erase pulse Pf and sustain pulses Ps are sequentially applied to the cells on each Y-electrode, and a sustain period CYm during which only sustain pulses are applied.

The write pulse generates a wall charge in the cells on each line; and the era se pulse Pf erases the wall charge. However, for a cell to be lit a cancel pulse Pc is selectively applied to the cell's X-electrode $X_1$ concurrently to the erase pulse application so as to cancel the erase pulse Pf. Accordingly, the wall charge (see FIG. 10) remains only in the cell applied with the cancel pulse Pc, that is, where the cell is written. Sustain pulses Ps are concurrently applied to all the cells; however, only the cells having the wall charge are lit.

Gradation of visual brightness, i.e. a gray scale, is proportional to the number of sustain pulses that light the cells during a frame. Therefore, different time lengths of sustain periods CYm are allocated to the subframes in a single frame, so that the gradation is determined by an accumulation of sustain pulses in the selectively operated subframes each having different number of sustain pulses.

Problem in the prior art methods is in that the second subframe must wait the completion of the first subframe for all the lines creating an idle period on each line. Therefore, if the number of the lines m=400 and 60 frames per second to achieve 16 grades (n=4), the time length $T_{SF}$ allowed to a single subframe period becomes as short as about 10 $\mu$s as an average.

Because $T_{SF} \times 60 \times 400 \times 4 = 1$ sec. For executing the write period and the sustain period in such a short period, the driving pulses must be of a very high frequency. For example, in the case where the numbers of sustain pulses are 1, 2, 4 and 8 pairs in the respective subframes to achieve 16 grades, the driving pulses must be as high as 360 kHz as derived from:

$$\text{freq.} = (1+2+4+8) \times 60 \times 400 = 360 \times 10^3 \text{ Hz.}$$

The higher frequency drive circuit consumes the higher power, and allows less margin in its operational voltage due to the storage time of the wall charge, particularly in an AC type PDP. Moreover, the high frequency operation, such as 360 kHz, may cause a durability problem of the cell. Therefore, the operation frequency cannot be easily increased, resulting in a difficulty in achieving the gradation.

Furthermore, in the above prior art method, a write period CYw of a line must be executed concurrently to a sustain period CYm of another line. This fact causes another problem in that the brightness control, for example, the gradation control to meet gamma characteristics of human eye, cannot be desirably achieved.

SUMMARY OF THE INVENTION

It is a general object of the invention to provide a method and circuit which allow a high degree of gradation of visual brightness of a flat display panel by requiring less time for addressing cells to be lit.

According to a method and circuit of driving a flat display panel formed of a plurality of cells each having a memory function, each of the cells being formed at a cross point of a plurality of X-electrodes and a plurality of Y-electrode orthogonal to the X-electrodes, a period of a frame for displaying a single picture is divided into a plurality of sequential subframes. Each of the subframes comprises: an addressing period during which cells to be lit later in a display period are selected from all the cells by being written by having a wall charge therein; and the display period subsequent to the address period for lighting the selected cells by applying sustain pulses to all the cells. A number of the sustain pulses included in: each display period is predetermined differently for each subframe according to a weight given to each subframe. Gradation of visual brightness of each cell is determined by the accumulated number of the sustain pulses included in the subframes which are selectively operated during a single frame according to the brightness level specified in a picture data to be displayed.

The above-mentioned features and advantages of the present invention, together with other objects and advantages, which will become apparent, will be more fully described hereinafter, with references being made to the accompanying drawings which form a part hereof, wherein like numerals refer to like parts throughout.

A BRIEF DESCRIPTION OF THE DRAWINGS

FIG. 1 schematically illustrates a prior art structure of a frame to drive each line of a matrix display panel;

FIG. 2 schematically illustrates waveforms in the prior art frames;

FIG. 3 illustrates a structure of a frame of the present invention;

Figure 6:
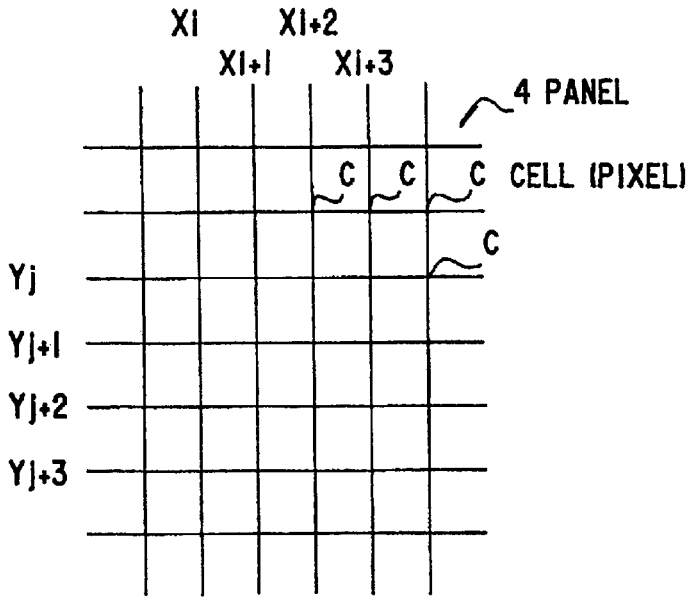
Figure 8:
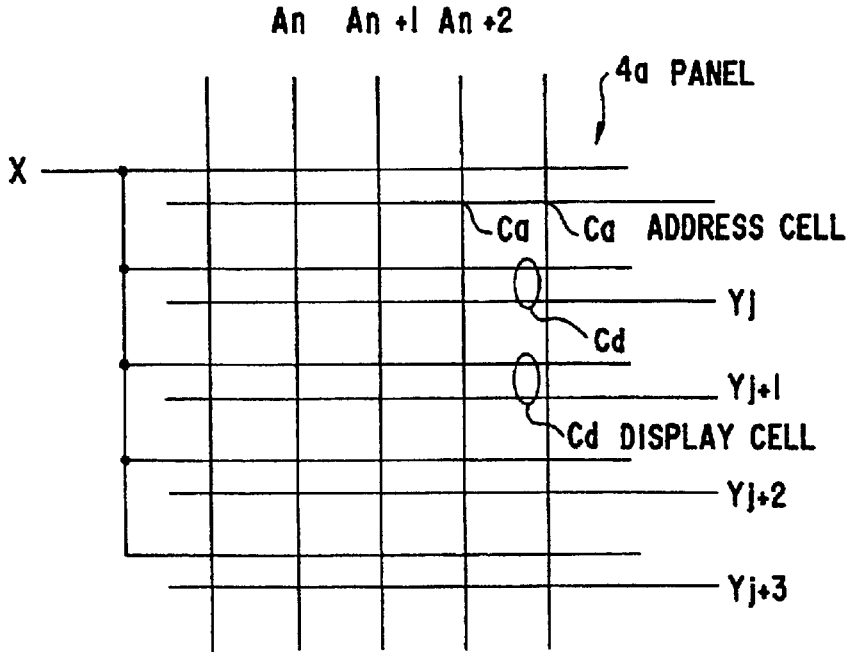
Figure 7:
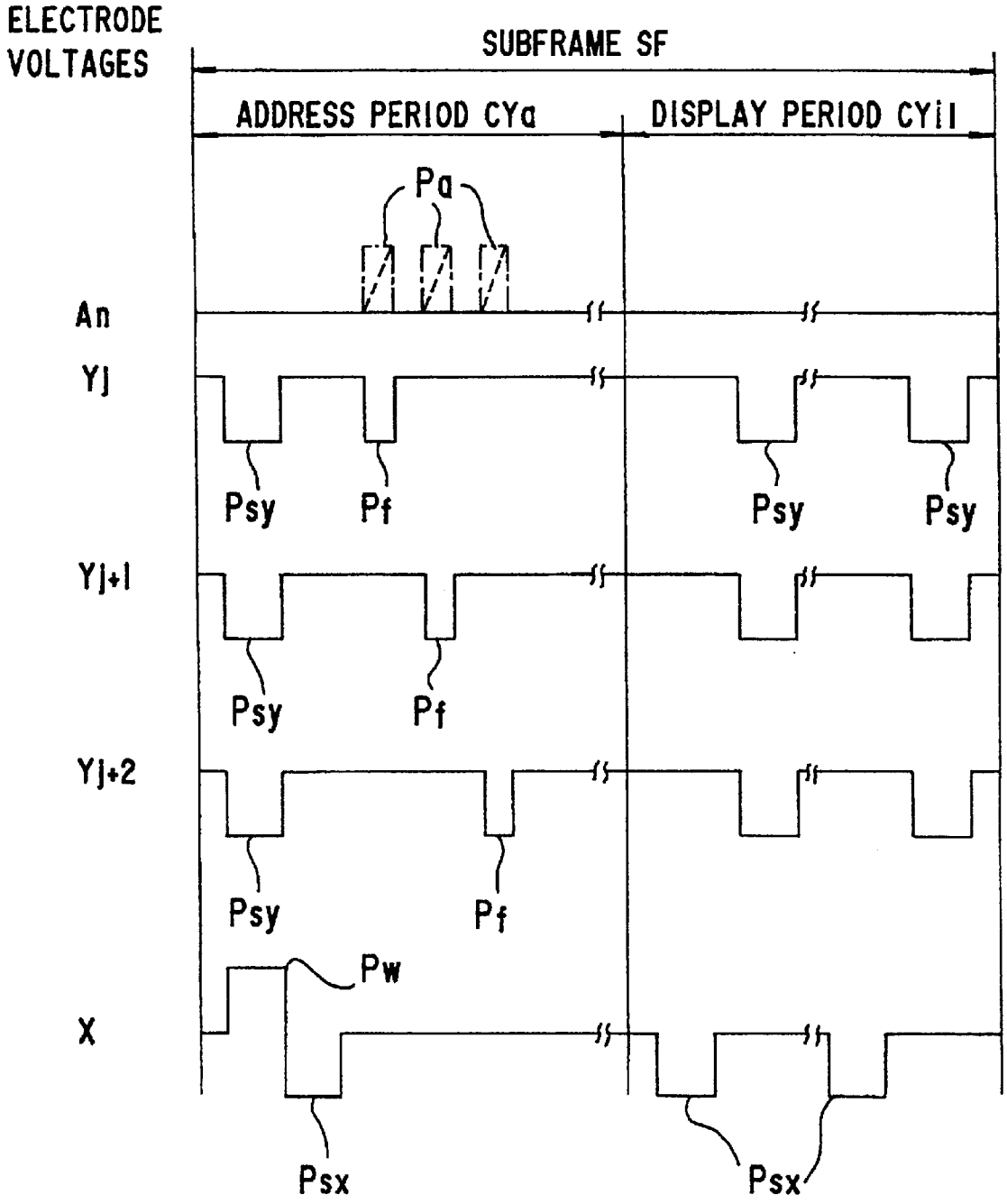
Figure 9:
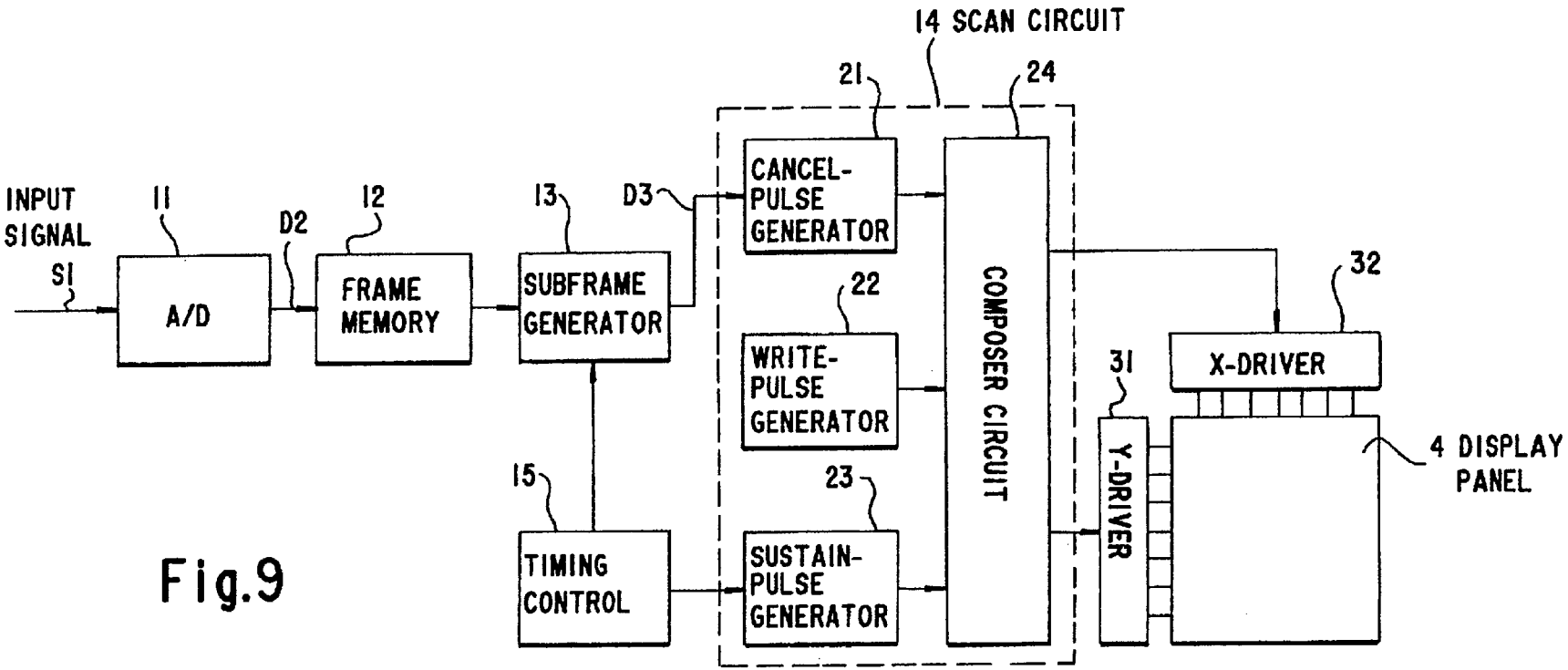
Figure 10:
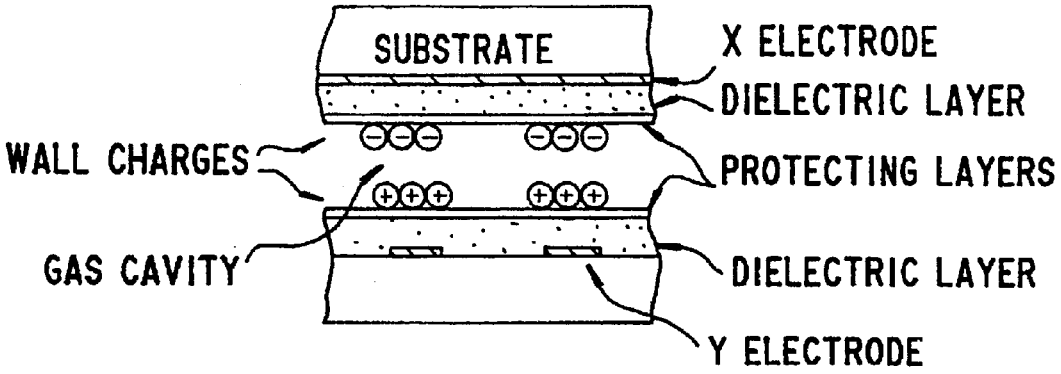
Fig.10 PRIOR ART

FIG. 6 schematically illustrates the structure of a flat display panel of an opposed-discharge type employed in the first preferred embodiment;

FIG. 7 illustrates voltage waveforms applied to Y-electrodes and X-electrodes, of a second preferred embodiment;

FIG. 8 schematically illustrates the structure of a flat display panel of a surface discharge type employed in the second preferred embodiment;

FIG. 9 schematically illustrates a block diagram of a driving circuit configuration according to the present invention;

FIG. 10 shows a wall charge; and

Figure 11:
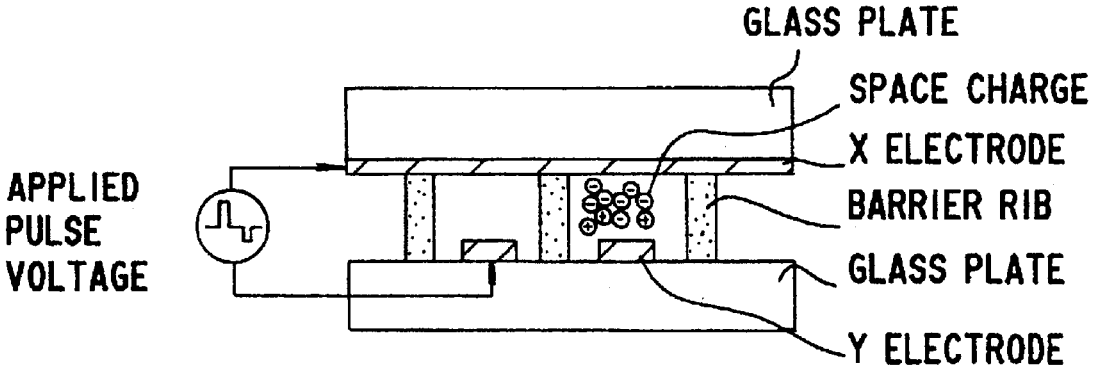
Fig.11 PRIOR ART

FIG. 11 shows a space charge.

DESCRIPTION OF THE PREFERRED EMBODIMENT

FIG. 3 schematically illustrates a frame structure of a first preferred embodiment of a drive waveform for driving a panel in accordance with the present invention. A frame FM to drive a single picture on a flat display panel, such as a PDP or an electroluminescent panel, is formed of a plurality of, for example, eight subframes SF1 to SF8. Each subframe is formed of an address period CYa and one of display periods CYi1 . . . CYi8 subsequent to each address period CYa1 . . . CYa8. In each address period CYa, the cells to be lit are addressed by being written selectively from all the remaining cells of the panel. A practical operation in the address period CYa, according to the present invention, will be described later in detail. The display periods CYi1 to CYi8 have respective, different time lengths, essentially having a ratio 1:2:4:8:16:32:64:128, so that respective, different numbers of sustain pulses of a common frequency are included, approximately in proportion to this ratio, in the display periods of the respective subframes. Visual brightness, i.e., the gradation of the brightness of a lit cell is determined by the number of the sustain pulses accumulated for the single (i.e., individual) frame period. Thus, the gradation of 256 grades, defined by 8 bits, can be determined for each cell by selectively operating one or a plurality of the eight subframes.

Figure 2:
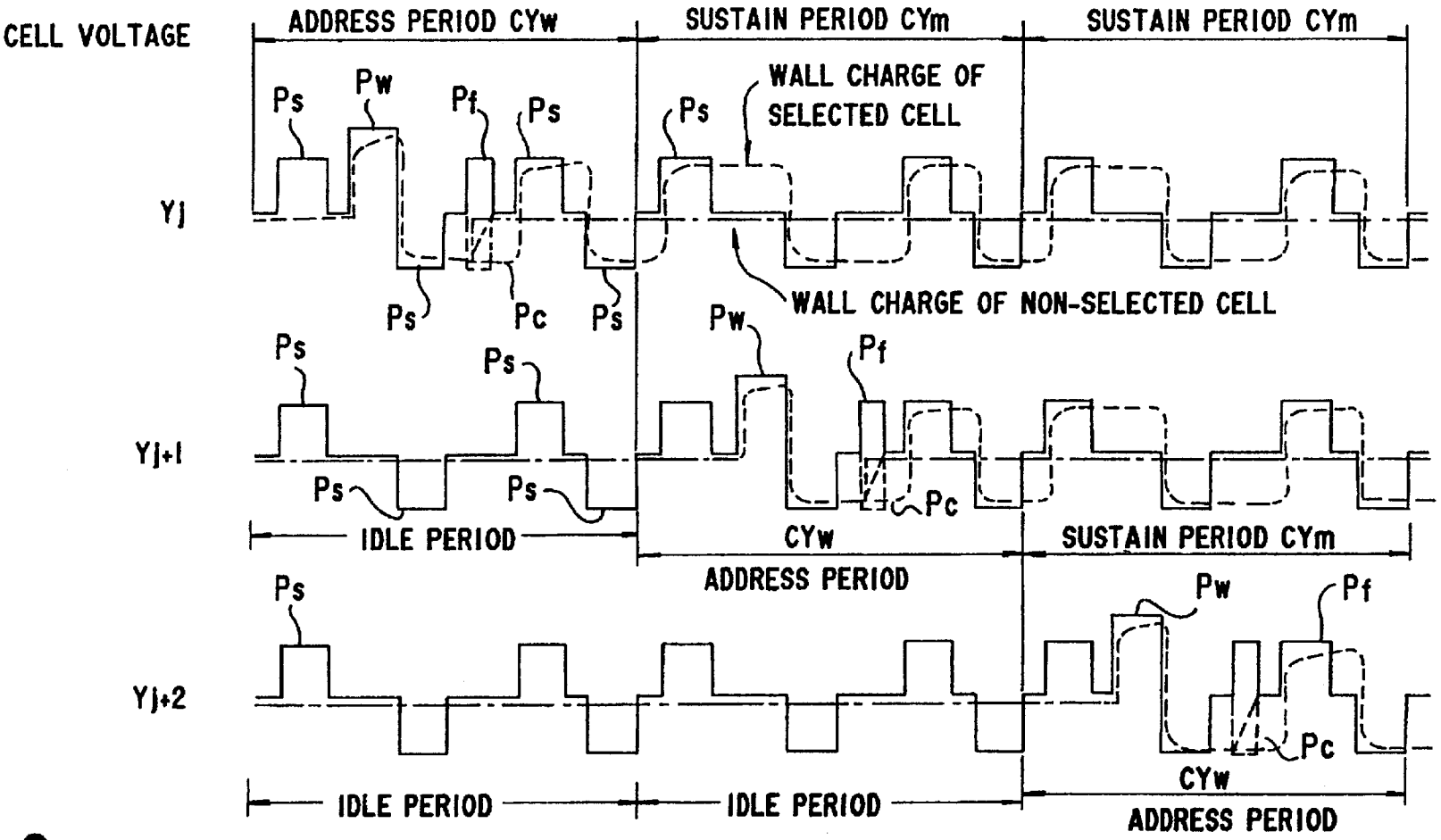
Fig.2 PRIOR ART
Figure 4:
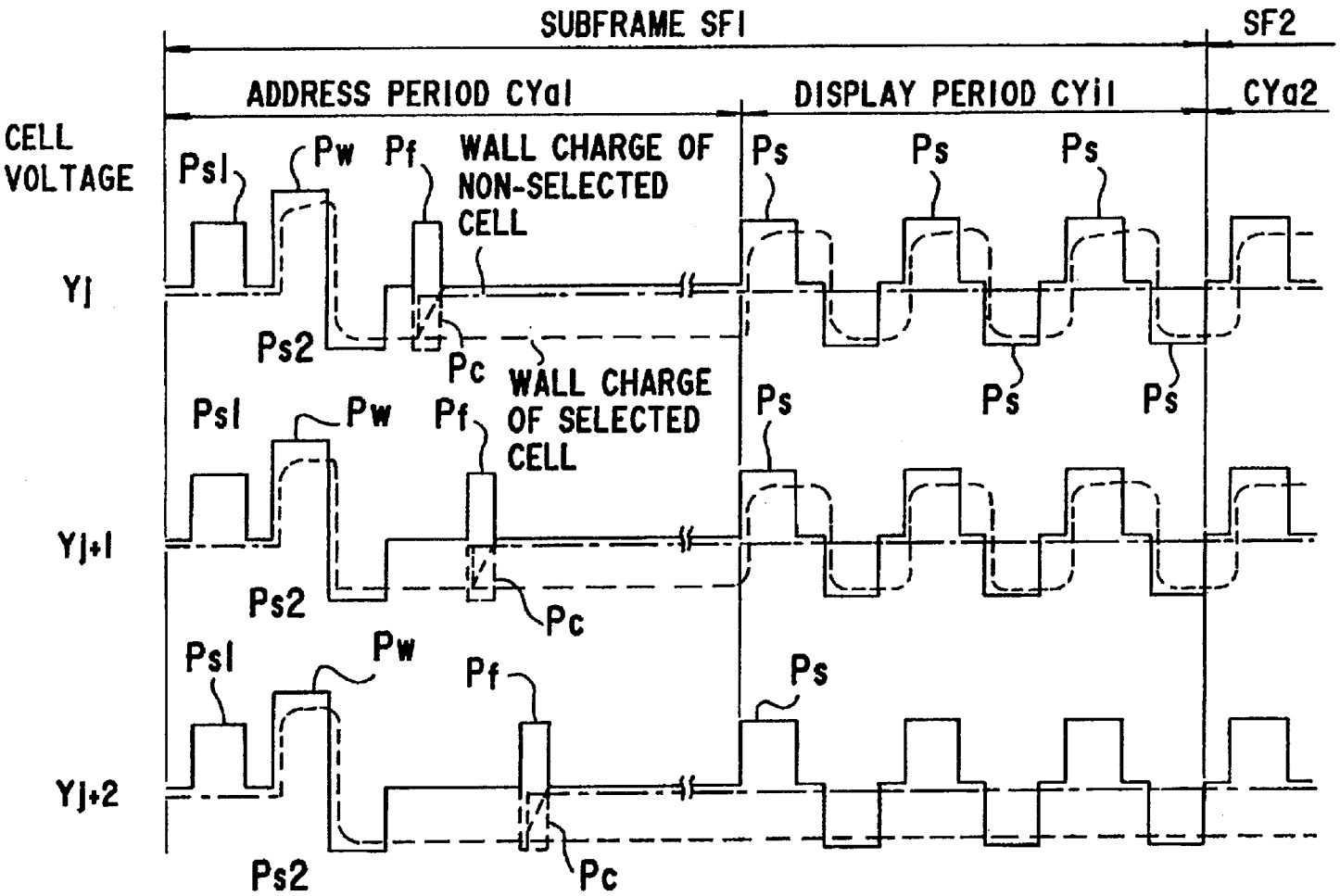
FIG. 4 illustrates waveforms of cell voltages applied across a cell on each line in a subframe.

FIG. 4 shows voltage waveforms applied across the cells of an opposed-discharge type PDP of the invention, as hereinabove described, where a discharge takes place between matrix electrodes coated with insulating layers formed respectively on two glass panels facing each other. A layout of the matrix electrodes is schematically shown in FIG. 6; for the present explanation of the invention, the X-electrodes $X_f$, $X_{f-1}$, $X_{f-2}$. . . are data electrodes and the Y-electrodes $Y_j$, $Y_{j+1}$, $Y_{j+2}$ . . . are scan electrodes. Cells C are formed at crossing points, or intersections, of the X-electrodes and the Y-electrodes.

Figure 5:
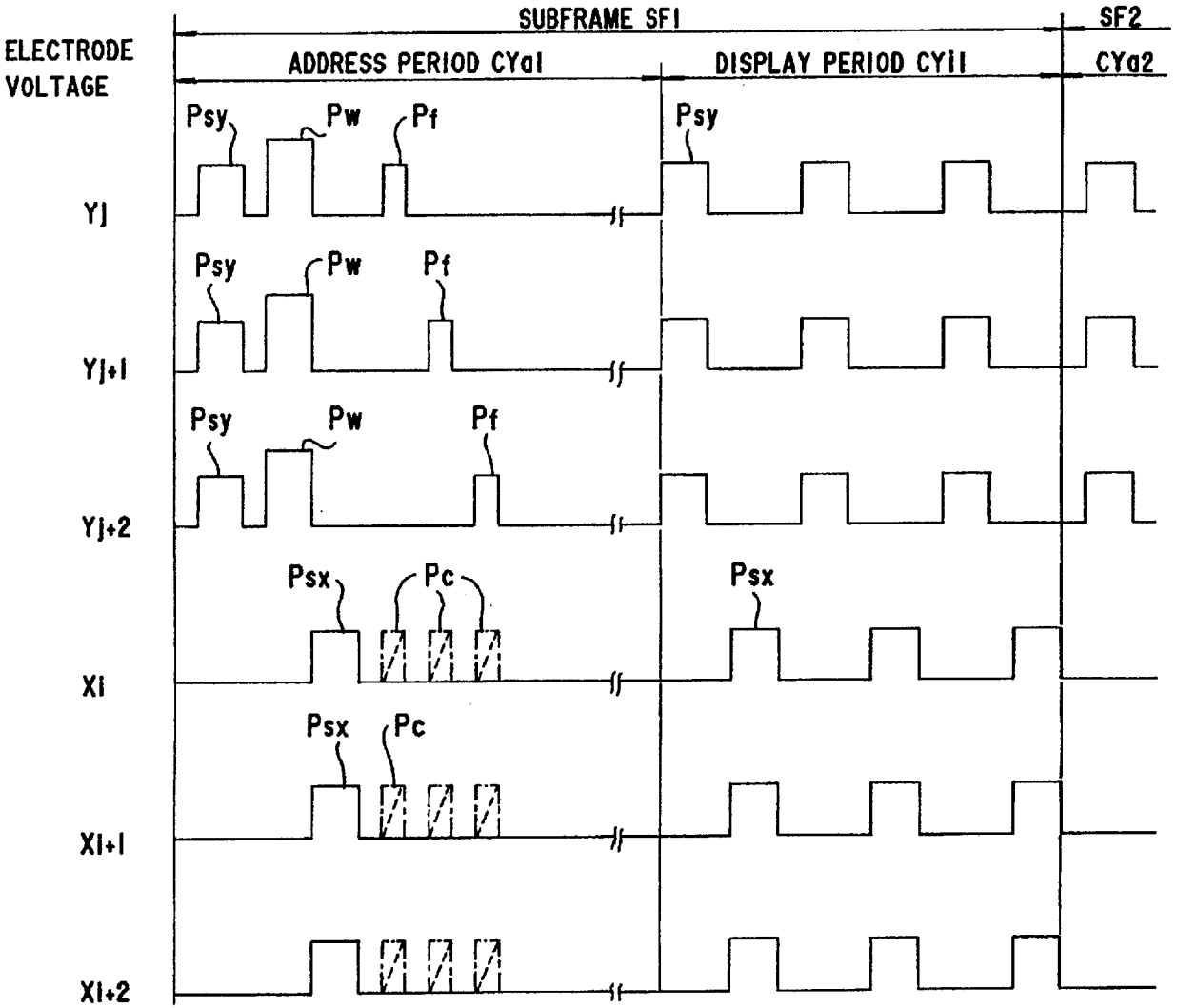
FIG. 5 illustrate voltage waveforms applied to Y-electrodes and X-electrodes, of a first preferred embodiment of the present invention.

Operation of the address period CYa is hereinafter described in detail. Voltage waveforms respectively applied to each of the X-electrodes and the Y-electrodes and producing the cell voltages of FIG. 4 are shown in FIG. 5. A sustain pulse Ps1 is applied to all the Y-electrodes in the same polarity as the subsequent write pulse; in other words, each sequence of sustain pulses ends at a sustain pulse having the polarity of the write pulse. Su'stain pulses are typically 95 volt high and 5 $\mu$s long. Next, approximately 2 $\mu$s later, a write pulse Pw is applied to all the cells by applying a pulse Pw concurrently to all the Y-electrodes while the X-electrodes are kept at 0 volt; the write pulse Pw is typically 150 volt high and 5 $\mu$s long, adequate for both igniting a discharge as well as forming a wall charge (see FIG. 10), as a memory medium, in all the cells. Immediately subsequent to the write pulse Pw, a second sustain pulse Ps2 having a polarity opposite to that of the write pulse Pw is applied to all the cells by applying the sustain pulse voltage Psx to all the X-electrodes while the Y electrodes are kept at 0 volt, in order to invert the wall charge by which the subsequent erase pulse Pf can be effective. Next, an erase pulse Pf, of typically 95 volt and 0.7 to 1 $\mu$s duration, is applied sequentially to each of the Y-electrodes; in other words, the Y-electrodes are scanned individually and in succession. Concurrently with the erase pulse application, a cancel pulse Pc having substantially the same level and the same width as the erase pulse Pf is selectively applied to an X-electrode connected to a cell to be lit, in order to cancel the function of the erase pulse Pf. Though a cell to which no cancel pulse is applied is lit once by the front edge of the erase pulse Pf, the pulse width is not sufficiently long so as to accumulate an adequate wall charge to provide the memory function. That is, the wall charge is erased so that the cell, so addressed, is not lit later. Thereby the writing operation, which has addressed the cells to be lit by cancelling the function of the erase pulse, is completed throughout the panel. Thus, the address period is approximately 621 $\mu$s long for a 400-line picture. If a sustain pulse Ps1 is not applied, in other words, if the display period ends at the sustain pulse having the polarity opposite to the write pulse, the change in the cell voltage upon the following application of the write pulse is equal to the sum of the voltage levels of the sustain pulse and the write pulse. This large change in the cell voltage may cause a deterioration of the insulation layers of the cell. Thus, the sustain pulse Ps1 is preferably introduced into the address period, but is not absolutely necessary. In each address cycle, all the cells are lit three (3) times, namely, by the sustain pulse Psy, the write pulse Pw and the erase pulse Pf; however, these three (3) lightings are negligible compared with the far larger number of cell lightings produced in the display cycles.

A first display period CYi1, provided subsequently to the first address period CYa1, is approximately 46 μs long. The sustain pulses are typically 5 μs wide and typically have a 2 μs interval therebetween; therefore, three pairs of the sustain pulses of frequency 71.4 kHz are included in the first display period CYi1. The sustain pulses are applied to all the cells by applying the sustain pulse voltage Psy, in a current phase, to all the Y-electrodes and, in the next phase, by applying the sustain pulse voltage Psx to all the X-electrodes. Thus, the cells which were addressed, i.e., having the wall charge, in the first address period CYa1 are lit by the sustain pulses in the subsequent display period CYi1 of subframe SF1. The first subframe SF1 is now completed.

In the second address period CYa2 of the second subframe SF2, subsequent to the first display period CYi1, the cells to be lit during the second display period CYi2 are addressed in the same way as in the first address period. The second display period CYi2, subsequent to the second address period CYa2, is approximately 91 μs long, so as to contain 6 pairs of sustain pulses.

In the further subsequent subframes SF3 . . . SF8, the operations are the same as those of the first and second subframes SF1 and SF2; however, the time length, or duration, and the number of the sustain pulses contained therein are varied as calculated below:

a frame period of 60 frames per second: 16,666 ms;

address period as described above: 621 μs;

total time length occupied by address periods of 8 subframes: 621×8=4,9168 μs;

time length allowed for 8 display periods: 16,666−4,968=11,698 μs;

time length to be allocated to a minimum unit of 256 grades (represented by 8 bits): 11,698/256=45.67 μs;

time length TL of each display period of other subframes: TL=45.67×2, 4, 8, 16, 32, 64 and 128 μs, respectively; accordingly:

| display period time length: | | | number of sustain pulse pairs: | |
|---|---|---|---|---|
| 1st SF | approx. | 45 μs | approx. | 3 |
| 2nd SF | | 91 | | 6 |
| 3rd SF | | 182 | | 13 |
| 4th SF | | 365 | | 26 |
| 5th SF | | 730 | | 52 |
| 6th SF | | 1,461 | | 104 |
| 7th SF | | 2,924 | | 209 |
| 8th SF | | 5,845 | | 418 |
| total | | | | 831 |

frequency of sustain pulses having a 14 μs period: 1/14 μs=71.4 kHz.

Accordingly, a total number of sustain pulse pairs in each second is 831×60=49,860, which is sufficient to provide the brightness of the maximum gradation.

Though, in the above preferred embodiment, the respective time periods, or directions, of the display periods are different thereby to provide different numbers of sustain pulses, the display periods may be allocated constantly to each subframe, for example: 11,698 μs/8=1,462 μs, during which respective, different numbers of the sustain pulses are contained. For varying the sustain pulse numbers, the frequency may be varied for each subframe, such as 0.75, 1.5, 3, 6, 12, 24, 48 and 96 kHz, where the numbers of the sustain pulse pairs are 1, 2, 4, 8, 17, n35, 70 and 140, respectively. In the constant time length 1,462 μs of the display periods, sustain pulses may be of a constant frequency, such as 96 kHz, where unnecessary pulses are killed (i.e., deleted, or blanked) so as to leave a necessary, i.e., appropriate, number of sustain pulses in each display period.

A second preferred embodiment of the present invention, applied to a surface discharge type PDP, is hereinafter described. The surface discharge type PDP may be of the widely known type disclosed in Japanese Unexamined Patent Publication Tokukai Sho 57-78751 and 61-39341, or schematically illustrated in FIG. 8. A plurality of X-electrodes X, parallel to and positioned close to respective ones of a plurality of Y-electrodes $Y_j$, $Y_{j-1}$, $Y_{j-2}$ . . . , and plural address electrodes An, An+1, An+2, . . . orthogonal to the X and Y electrodes, are arranged on a surface of a panel. Electrodes crossing each other are insulated with an insulating layer. An address cell Ca is formed at each of the crossed points of the Y-electrodes $Y_j$, $Y_{j+1}$, $Y_{j+2}$ and the address electrodes An, An+1, An+2, . . . . Display cells Cd are formed between the adjacent, associated Y-electrode and X-electrode, close to the corresponding address cells Ca, respectively. Voltage waveforms applied to the X-electrodes X, the Y-electrodes $Y_j$, $Y_{j+1}$, $Y_{j+2}$, . . . and the address electrode An are shown in FIG. 7. An address period CYa is performed concurrently with respect to all the Y-electrodes. In each address period, a write pulse Pw, typically 5 μs long and 90 volt high, is applied to all the X-electrodes while a first sustain pulse Psy1, that is opposite in polarity to the write pulse Pw and typically 5 μs long and 150 volt high, is applied to all the Y-electrodes, and the address electrodes are kept at 0 volt. Accordingly, all the display cells Cd are discharged by the summed cell voltage 240 V=90 V+150 V. Next, immediately subsequently to the write pulse, a second sustain pulse Psx, typically 5 μs long and 150 volt high and of an opposite polarity to the write pulse Pw, is applied to all the X-electrodes, so that a wall charge is generated in each display cell Cd and in a part of the associated address cell Ca.

Next, an erase pulse Pf, typically 150 volt high and 3 μlong, is applied sequentially to each of the Y-electrodes in the same manner as the first preferred embodiment. Concurrently to the erase pulse application, an address pulse Pa, typically 90 volt high and 3 μlong, is selectively applied to an address-electrode of a display cell Cd which is not to be lit later in the subsequent display period CYi1 and thus in the same way as that of the first preferred embodiment, whereby the wall charge is erased. At a cell to which no address pulse is applied, the wall charge is maintained. Thus, the cells to be lit later are addressed, throughout the panel, by maintaining the wall charge in the selected cells.

In a first display period CYi1 subsequent to the first address period CYa1 , sustain pulses, typically 150 volt high and 5 μs long, are applied to all the cells by applying sustain pulses Psy to all the Y-electrodes and sustain pulses Psx alternately to all the X-electrodes. The cells having been addressed to have the wall charge are lit by the sustain pulses. In the subsequent subframes the same operations are repeated as those of the first subframe, except that the respective time lengths of the display periods are different in each subframe, as the same way as that of the first preferred embodiment. The time length allocated to each subframe is identical to that of the first preferred embodiment. Accordingly, the same advantageous effects can be accomplished in the second embodiment, as well.

Though in the above preferred embodiments the time length allocation is done in such a manner that the first subframe has the shortest display period and the last subframe has the longest display period, it is apparent that the order of the time length allocation is arbitrarily chosen.

FIG. 9 shows a block diagram of a driving circuit of the present invention for providing gradation of the visual brightness of a flat matrix panel. An analog input signal S1, of picture data to be displayed, is converted by an A/D converter 11 to a digital signal D2. A frame memory 12 stores the digital signal D2 of a single frame FM output from A/D converter 11. A subframe generator 13 divides a single frame of picture data D2 stored in the frame memory 12 into plural subframes SF1, SF2 . . . according to the required gradation level, so as to output respective subframe data D3. A scanning circuit 14 scans a Y-electrode driver 31 and an X-electrode driver 32 of the display panel 4. The scanning circuit 14 comprises a cancel pulse generator 21 to generate the cancel pulses Pc of the first preferred embodiment as well as the address pulses Pa of the second preferred embodiment; a write pulse generator 22 to generate the write pulses Pw; a sustain pulse generator 23 to generate the sustain pulses Ps; and a composer (i.e., combiner) circuit 24 to compose, or combine, these signals. A timing controller 15 outputs several kinds of timing signals for timing functions, such as process timing of subframe generator 13, output timing of the cancel pulse generator, and termination of timing of the display period, in each subframe.

Operation of the gradation drive circuit is hereinafter described. The waveforms applied to the panel are the same as those already described above. In the case where the picture data, each of whose pixels has n bit picture data, is stored in frame memory 12 so that the picture is displayed by a 2" level brightness gradation, subframe generator (processor) 13 sequentially outputs n kinds of binary data D3, i.e., pixel position data identifying the position of each pixel to be selected, or turned ON, in each subframe, of a picture to be exclusively formed of the respective gradation bits for each pixel, in the order from the least significant bit to the most significant bit and thus from the brightness data of the lowest level up to the brightness data of the highest level bit. Depending on this picture data D3, the cancel pulse generator 21 outputs cancel pulses Pc, at the moment when a line is selected, to X-electrodes connected to the cells to be addressed, and thus to be lighted, on this selected Y-electrode. Timing controller 15 outputs a timing control signal so that the time length of each display period of subframes becomes a predetermined length in accordance with picture data D3 for the pixel position data output from subframe processor (generator) 13. Composer (combiner) circuit 24 outputs the scan voltages shown in FIG. 5 by combining the respective pulse signals output from the pulse generators 21, 22 and 23 so that the address period CYa and the display hit) period CYi can be executed in each subframe SF.

In the first and second preferred embodiments, the erase/cancel pulses may be as short, or brief, as 1 $\mu$s and may require only 600 $\mu$s for addressing the cells to be lit on the 400 lines after the concurrent application of the write pulse to all the cells. Thus, the amount of time required for the addressing operation is drastically decreased, compared with the FIG. 1 prior art method wherein the duration of the write pulses Pw, i.e., as long as 5 $\mu$s, occupy about 2.2 ms for individually addressing the 400 lines. As a result, the time for the display periods may be as large as 11.7 ms, which is enough to provide a 256-grade gradation. Accordingly, the driving frequency can be lowered in accomplishing the same gradation level. The lower driving frequency lowers the power consumption in the driving circuit, as well as allows a longer pulse width, which provides more margin in the operation reliability.

Moreover, the method of the present invention solves the prior art problem in that the driving circuit configuration is complicated, because the write period CYw of a line must be executed concurrently to the sustain period CYm of the other lines; accordingly, the pulses must be of very high frequency.

Furthermore, in the present invention, the number of sustain pulses in each subframe can be easily chosen because the display period CY1 is completely independent of the address period CYa, since the cycle of the sustain pulses does not need to synchronize with the cycle of the address cycle.

Owing to the above-described advantages afforded by the driving method and circuit of the present invention, the gradation can be easily controlled, the ratio of the respective time duration of the display periods in the subframes can be arbitrarily and easily chosen so that the gradation can meet the gamma characteristics of human eyes and, accordingly, the present invention is advantageous in affording freedom in designing the circuit, the production cost and the product reliability, as well.

Though in the address period, of the above preferred embodiments, the addressing operation is carried out by canceling the once-written cells, it is apparent that the addressing method may be of other conventional methods wherein the writing operation is carried out only on the cells to be lit, without "writing-all" and "erasing-some-of-them." Even in this case, the same advantageous effect can be achieved as in the above preferred embodiments.

Though only a single example of the circuit configuration is disclosed above as a preferred embodiment, it is apparent that any other circuit configuration, embodying the spirit of the present invention may be employed.

Though only two examples of the driving waveforms are disclosed in the above preferred embodiments, it is apparent that other waveforms embodying the spirit of the present invention may be employed.

Though only two examples of the electrode configuration of the display panel are disclosed in the above, preferred embodiments, it is apparent that other electrode configurations, embodying the spirit of the present invention, may be employed.

Though in the above, preferred embodiments, an AC-type PDP is referred to in which the memory medium is formed of a wall charge, it is apparent that the present invention may be embodied in other flat panels where the memory medium is formed of a space charge (see FIG. 11), such as a DC-type PDP, an EL (electroluminescent) display device, or a liquid crystal device.

The many features and advantages of the invention are apparent from the detailed specification and thus, it is intended by the appended claims to cover all such features and advantages of the methods which fall within the true spirit and scope of the invention. Further, since numerous modifications and changes will readily occur to those skilled in the art, it is not detailed to limit the invention and accordingly, all suitable modifications are equivalents may be resorted to, falling within the scope of the invention.

What is claimed is:

1. A method for driving a flat display panel with a gradation of visual brightness, the display panel having a plurality of pixels arranged in plural lines, each line having plural pixels and each pixel having a memory function, the method comprising:

dividing, with time, each frame to be displayed on said display panel into a respective plurality of successive subframes, the subframes having respective, predetermined weights of brightness gradations and being individually selected to determine the brightness gradation of the respective frame, each subframe being applied at a common timing with respect to all of the plural lines of the display panel;

further dividing, with time, each of the subframes into respective, first and second successive time periods, each time period having a respective, common timing with respect to all of the plural lines forming the display panel;

controlling respective timings of a start of the first time period and of an end of the second time period of each subframe to be in common for all of the plural lines forming the display panel;

setting the time duration of the second time period of each subframe in correspondence to the respective weight of the brightness gradation of that subframe;

in the first time period of each subframe, writing display data in corresponding pixels of the display panel by selectively forming a memory medium in each of the corresponding pixels;

in the second time period of each subframe, concurrently producing a display in each corresponding pixel in which a respective memory medium was formed in the first time period, for the respective time duration of the second time period of the subframe; and repeating the operations of the subframe with the first time period and the second time period so as to display a picture with gradation.

2. A method for driving a flat display panel with a gradation of visual brightness, the display panel having a plurality of pixels arranged in plural lines, each line having plural pixels and each pixel having a memory function, the method comprising:

dividing, with time, each frame to be displayed on said display panel into a respective plurality of successive subframes, the subframes having respective, predetermined weights of brightness gradations and being individually selected to determine the brightness gradation of the respective frame, each subframe being applied at a common timing with respect to all of the plural lines of the display panel;

further dividing, with time, each of the subframes into respective, first and second successive time periods, each time period having a respective, common timing with respect to all of the plural lines forming the display panel;

controlling respective timings of a start of the first time period and of an end of the second time period of each subframe to be in common for all of the plural lines forming the display panel;

setting the time duration of the second time period of each subframe in correspondence to the respective weight of the visual brightness gradation of that subframe;

in the first time period, and at a common timing for each line of pixels and in succession for the plural lines, selectively forming a memory medium in each selected pixel of the plurality of pixels of said display panel using a first pulse train of a first pulse pitch;

in said second time period of each subframe, concurrently producing a display at each selected pixel, in which a memory medium was formed, for the time duration of the second time period of the respective subframe and in succession for the plural subframes of each frame using a second pulse train having a second pulse pitch, a respective number of pulses of the second pulse train being supplied for display in the second time period in accordance with the predetermined weights of the brightness gradations thereof; and repeating the operations of the subframe with the first time period and the second time period so as to display a picture with gradation.

3. A method of driving a matrix display panel as claimed in claim 2, wherein the first and second pulse pitches are of different values.

4. A method of driving a matrix display panel as claimed in claim 3, wherein the second pulse train has a common pulse pitch in each of the plurality of successive subframes of a frame.

5. A method of driving a matrix display panel as claimed in claim 2, wherein the respective, second time periods of the plurality of successive subframes are of a common duration and, for the plurality of successive subframes, the respective second pitches of the respective second pulse train are of respective, different values in accordance with the predetermined, different weights of the respective visual brightness gradations of the successive subframes.

6. A method of driving a matrix display panel having a plurality of cells arranged in a plurality of lines, each of the cells having a memory function, the method comprising:

dividing a period of a display frame of plural lines into a plurality of successive subframes, each subframe having an addressing period during which cells to be lit later in a display period are selected from all of the cells so as to have a wall charge therein, and a display period subsequent to the addressing period for lighting the selected cells by concurrently applying sustain pulses to all of the cells, each display period being independent of the addressing period for the all lines, the respective numbers of sustain pulses applied in the plurality of successive subframes depending on predetermined weights of brightness gradations of the plurality of successive subframes.

7. A method of driving a matrix display panel as recited in claim 6, wherein the respective numbers of sustain pulses applied in the displaying periods of the plurality of successive subframes are chosen so that the visual brightness gradations meet desired gamma characteristics.

8. A method of driving a matrix display panel having a plurality of pixels arranged in a plurality of lines, each of said pixels having a memory function, said method comprising:

dividing a period of a display frame into a plurality of subframes, wherein the plurality of lines are concurrently activated in each subframe, each subframe including respective and successive addressing and displaying periods;

in each addressing period, addressing a pixel by selectively forming a memory medium, according to said memory function, in a selected pixel of a selected line, sequentially for the plurality of lines, and, in the respective, successive displaying periods, lighting each addressed pixel by concurrently applying sustain pulses to all the pixels, the plurality of successive subframes being allocated respective, predetermined numbers of the sustain pulses in accordance with respective, predetermined weights of visual brightness gradations thereof; and an order of the respective subframes of a frame being selected arbitrarily in advance of producing a display in accordance with display conditions.

9. A method of driving a plasma display panel having a plurality of parallel first electrodes, a plurality of second electrodes each of which is disposed between adjacent ones of said first electrodes and a plurality of third electrodes in parallel with each other in a crossing direction relative to said first and second electrodes, a plurality of first cells being formed substantially at respective first positions defined by crossed points of the first electrodes and said third electrodes and a plurality of second cells being formed between the first electrodes and the second electrodes at respective second positions corresponding to the first positions of the first cells, wherein the first cells are selectively addressed corresponding to a picture to be displayed and said second cells display the picture corresponding to the selected ones of the first cells, the method comprising:

dividing a period of a display frame into a plurality of subframes, each subframe including respective and successive addressing and displaying periods, each said displaying period being independent of the addressing period with respect to all of the first and second cells;

in each addressing period, addressing said first cells by selectively forming a wall charge in a selected one of said first cells on each sequentially selected one of said first electrodes, and, in the respective, successive displaying period, lighting said second cells corresponding to selected ones of said first cells by concurrently applying sustain pulses to all the second cells, the plurality of successive subframes being allocated respective, predetermined numbers of the sustain pulses in accordance with respective, predetermined weights of visual brightness gradations thereof; and an order of each one of said subframes is arbitrarily chosen in advance corresponding to a displaying condition.

10. A method as recited in claim 9, wherein the addressing further comprises:

applying a pulse concurrently between plural first electrodes and plural second electrodes while keeping plural third electrodes at a predetermined voltage, before the first cells are selectively addressed, so that respective wall charges are generated in each of the first and second cells.

11. A method of driving a matrix display panel, formed of a plurality of cells arranged in a plurality of lines, each cell being capable of having a charge accumulated therein, the method comprising:

dividing a period of a frame displaying a single picture into a plurality of successive subframes, each subframe including an addressing period and a displaying period which is independent of said addressing period with respect to all of the lines;

in each addressing period, performing an addressing operation by erasing the charge accumulated in each unselected cell of a selected line, in sequence for the plurality of lines and, in the related displaying period, the selected cells being lit by concurrently applying sustain pulses to all of the plurality of cells, wherein each subframe of the plurality of successive subframes is allocated a predetermined number of sustain pulses in accordance with respective, predetermined brightness gradations of the plurality of successive subframes, a gradation of brightness of a selected cell in a given frame being determined by the total number of sustain pulses applied to the cell in the respective subframes of the given frame.

12. A method of driving a matrix display panel, formed of a plurality of pixels each having a memory function, comprising:

dividing with time a period of a frame displaying a single picture into a plurality of subframes, each subframe comprising:

an address period, executed during a common time for all the pixels, to address a pixel by selectively forming a memory medium in a selected pixel of al the pixels, and a display period, independent from said address period, to light said addressed pixel by an application of sustain pulses to all the pixels, each display period of the respective subframe being allocated a predetermined number of said sustain pulses, said allocated number being different for each subframe so as to weight a gradation to said respective subframe, whereby a gradation of visual brightness of said lit pixel is determined by selectively performing the address operation in each address period of said divided subframe for each of said pixels for each frame.

* * * * *

UNITED STATES PATENT AND TRADEMARK OFFICE

CERTIFICATE OF CORRECTION

PATENT NO. : 6,630,916 B1
DATED : October 7, 2003
INVENTOR(S) : Tsutae Shinoda et al.

It is certified that error appears in the above-identified patent and that said Letters Patent is hereby corrected as shown below:

Title page,
Item [30], Foreign Application Priority Data, at each of lines 3 and 4, change "Apr. 8, 1992" to -- Apr. 24, 1992 --.

Signed and Sealed this

Tenth Day of February, 2004

JON W. DUDAS
*Acting Director of the United States Patent and Trademark Office*